US005488266A

United States Patent [19]

Aoki et al.

[11] Patent Number: 5,488,266

[45] Date of Patent: Jan. 30, 1996

[54] ELECTRO-LUMINESCENCE DEVICE

[75] Inventors: Masaaki Aoki; Isao Yokotsuka, both of Tokyo; Yoshihiro Ogata, Yamagata, all of Japan

[73] Assignee: Showa Shell Sekiyu K. K., Tokyo, Japan

[21] Appl. No.: 174,254

[22] Filed: Dec. 28, 1993

[30] Foreign Application Priority Data

Dec. 28, 1992 [JP] Japan ..... 4-347584

[51] Int. Cl.[6] ..... H01J 1/64

[52] U.S. Cl. ..... 313/509; 313/506

[58] Field of Search ..... 313/509

[56] References Cited

U.S. PATENT DOCUMENTS

| | | | |
|---|---|---|---|
| 4,418,118 | 11/1983 | Lindors | 428/336 |
| 4,877,994 | 10/1989 | Fuyama et al. | 313/503 |
| 4,904,901 | 2/1990 | Simopoulos et al. | 313/509 |
| 5,036,249 | 6/1991 | Pike-Biegunski et al. | 313/509 |
| 5,051,654 | 9/1991 | Nativi et al. | 313/506 |
| 5,068,157 | 11/1991 | Won | 428/670 |
| 5,074,817 | 12/1991 | Song | 445/24 |
| 5,078,634 | 1/1992 | Yoshioka | 445/25 |
| 5,107,175 | 4/1992 | Hirano et al. | 313/512 |
| 5,120,618 | 6/1992 | Mori et al. | 428/690 |
| 5,156,924 | 10/1992 | Taniguchi et al. | 428/690 |
| 5,189,405 | 2/1993 | Yamashita et al. | 313/512 |
| 5,283,117 | 2/1994 | Arai et al. | 428/343 |

FOREIGN PATENT DOCUMENTS

| | | | |
|---|---|---|---|
| 59-129197 | 8/1984 | Japan | H05B 33/20 |
| 62-76279 | 4/1987 | Japan | H05B 33/04 |
| 62-188197 | 8/1987 | Japan | H05B 33/04 |
| 2214129 | 8/1990 | Japan | H01L 21/56 |

*Primary Examiner*—Donald J. Yusko
*Assistant Examiner*—Lawrence O. Richardson
*Attorney, Agent, or Firm*—Sughrue, Mion, Zinn, Macpeak & Seas

[57] ABSTRACT

An electro-luminescence device is described, which includes a laminate composed of a transparent substrate having successively laminated thereon a transparent electrode, a luminous layer, a dielectric layer, and a back electrode, with a back protective material being adhered to the back electrode through an adhesive resin film, wherein the back protective material is a moisture impermeable protective material and the adhesive resin film is a thermoplastic resin film having a thickness of from 10 to 200 μm, and a method for production thereof is also described.

9 Claims, 1 Drawing Sheet

ELECTRO-LUMINESCENCE DEVICE

FIELD OF THE INVENTION

The present invention relates to an electro-luminescence device being used for display or illumination, and more particularly to a highly moisture resistant electro-luminescence device comprising an electro-luminescence layer composed of a transparent electrode, a luminous layer, a dielectric layer, and a back electrode formed on a transparent substrate, with a back protective material being adhered to the back electrode.

BACKGROUND OF THE INVENTION

In the electro-luminescence device according to the present invention, the electro-luminescence is generated by applying an alternating electric field to two electrodes in which a luminous material which is activated by an electric field is sandwiched therebetween.

For an electro-luminescence device using a transparent substrate such as a glass plate on the luminous surface side, a means of applying a moisture impermeable plate such as a glass plate to the back side thereof as a back protective material and sealing the periphery with a resin is proposed in JU-A-59-129197 (the term "JU-A" as used herein means an "unexamined published Japanese utility model application"), as shown in FIG. 4 of the accompanying drawings. That is, as shown in FIG. 4, the electro-luminescence device disclosed in JU-A-59-129197 is composed of a laminate of glass substrate 10, transparent electric conductive film 11, fluorescent layer 18, dielectric layer 17, back electrode 16, and glass substrate 14. In the device, the periphery is sealed with sealing resin 20. In addition, element 12 is a current collector, elements 13 and 19 are leading wires, and element 15 is a laminate (composed of 16, 17, 18 and 19). However, the foregoing means takes time for sealing the periphery of the electro-luminescence device with the resin and hence is not a good, efficient method for industrial use.

For improving the above-described problem, JP-A-62-76279 (the term "JP-A" as used herein means an "unexamined published Japanese patent application") proposes a method wherein, as shown in FIG. 3 of the accompanying drawings, electro-luminescence element 4, which is composed of a laminate of a polyester film and an electro-luminescence layer, is placed between transparent substrate 1 and back protective material 3 through adhesive resin films 2 and 2', respectively, and after heating, they are integrated in a body under a reduced pressure. As the adhesive resin film used in the foregoing method, a film of a thermoplastic resin such as an ethylene-vinyl acetate copolymer, a polyvinyl butyral, etc., having a thickness of about 800 μm is used. This is a well known sealing method in this art.

In the method of JP-A-62-76279, the efficiency of the adhesive property is improved but, as will be understood from FIG. 3, since the thickness of adhesive resin film 2 disposed between transparent substrate 1 and luminous layer 4 becomes uneven during the steps of softening by heating and caking by cooling in the adhesive step, a wavy pattern is observed on the surface of the finished electro-luminescence device, which reduces the beautiful appearance of the finished product.

Also, JP-A-62-188197 discloses an electro-luminescence device wherein, as shown in FIG. 2 of the accompanying drawings (also showing a process for manufacturing the electro-luminescence device of the present invention), transparent electrode 2, luminous layer 3, dielectric layer 4, and back electrode 5 are successively laminated on transparent substrate (glass substrate) 1 and an aluminum composite sheet is adhered to the back electrode side through adhesive resin intermediate film 7 as back protective material 6. The aluminum composite sheet used in the above electro-luminescence device is composed of an aluminum foil, both surfaces of which are laminated with a resin film. Since the foregoing electro-luminescence device does not have a resin film between transparent substrate 1 and luminous layer 3 and thus is different from the structure shown in FIG. 3 described above, the problem of reducing the appearance by the unevenness of the thickness of the adhesive resin film is solved. However, since in the electro-luminescence device, the end portions of adhesive resin intermediate film 7 are exposed at the edge portions of the electro-luminescence device, moisture permeates into the electro-luminescence device from the ends thereof, whereby a sufficient moisture resistance for practical use is not obtained.

JP-A-2-214129 proposes that for preventing the permeation of moisture from the ends of the adhesive resin film, the width of the sealing end portions is increased as large as possible. Since the width of the sealing end portions is too large, though, a problem in the effective areas of the electric members occurs, and a problem of permeation of moisture from the protective film occurs. Accordingly, an equation for calculating a preferred width of the sealing end portions from the thickness and moisture permeability of the protective film and the thickness and moisture permeability of the adhesive resin film is proposed. However, in the foregoing technique, there is a limit in the moisture permeability of the product, since the protective resin film has a moisture permeability to some extent.

SUMMARY OF THE INVENTION

As the result of various investigations on the adhesive property and the thickness of an adhesive resin film, in the case of using a transparent substrate such as a glass substrate on the luminous layer side of an electro-luminescence device and an aluminum composite sheet on the back side thereof to make it completely moisture impermeable, for reducing the permeation of moisture from the end portions of the adhesive resin film for adhering these moisture impermeable materials to each other to an amount as small as possible, the inventors have succeeded in accomplishing the present invention.

That is, as the result of investigations on the relation of the thickness of the foregoing adhesive resin film and the moisture permeability of the finished electro-luminescence device, it has been discovered that the moisture resistance has a large reliance on the thickness of the adhesive resin film and a very high moisture resistance is obtained when the thickness of the adhesive resin film is not thicker than 200 μm.

Thus, according to an aspect of the present invention, there is provided an electro-luminescence device comprising a laminate composed of a transparent substrate having successively laminated thereon a transparent electrode, a luminous layer, a dielectric layer, and a back electrode, with a back protective material being adhered to the back electrode through an adhesive resin film, wherein the back protective material is a moisture impermeable protective material and the adhesive resin film is a thermoplastic resin film having a thickness of from 10 to 200 μm.

Also, according to another aspect of the present invention, there is further provided a method of producing an electro-luminescence device, which comprises (1) forming an electro-luminescence layer by successively laminating a transparent electrode, a luminous layer, a dielectric layer, and a back electrode on a transparent substrate, (2) superposing an adhesive resin film having a thickness of from 10 to 200 μm and a moisture impermeable back protective film on the back electrode to form an assembly, (3) vacuum-degassing the assembly, (4) then heating the assembly to a temperature for melting or softening the adhesive resin film, and (5) then pressing the assembly at a pressure of up to 1 kg/cm$^2$ (specifically, in the range of 0 to 1 kg/cm$^2$), whereby the back protective material is adhered to the back electrode of the electro-luminescence layer.

The present invention can be similarly applied to the case of a structure in which the transparent substrate has thereon an electro-luminescence layer formed by successively laminating a transparent electrode, a luminous layer, and a back electrode (i.e., without including a dielectric layer).

Also, in the present invention, as the adhesive resin film being used for the electro-luminescence device, an adhesive film composed of a thermoplastic resin is used.

DETAILED DESCRIPTION OF THE INVENTION

Figure 1:
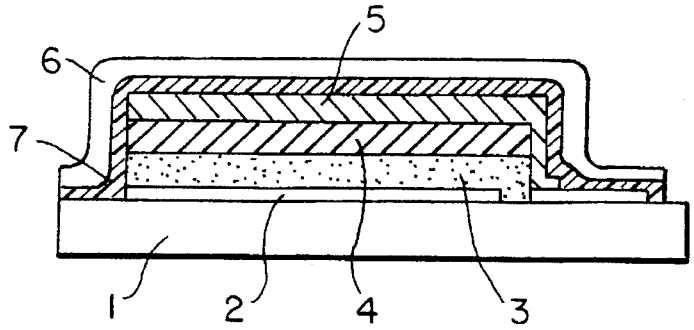
FIG. 1 is an enlarged cross sectional view showing an example of the electro-luminescence device of the present invention.
Figure 2:
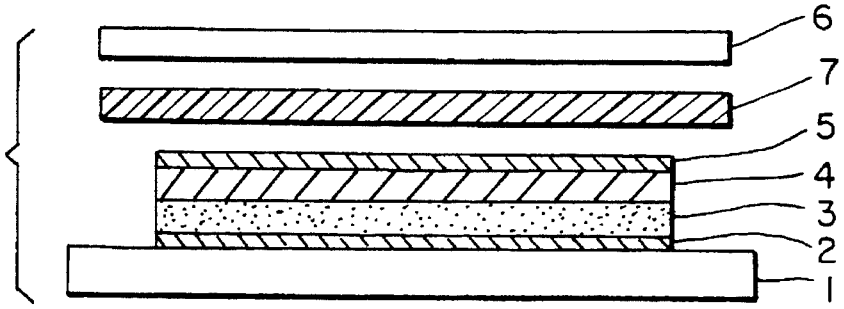
FIG. 2 is an enlarged schematic cross sectional view showing a process for manufacturing the electro-luminescence device of the present invention.
Figure 3:
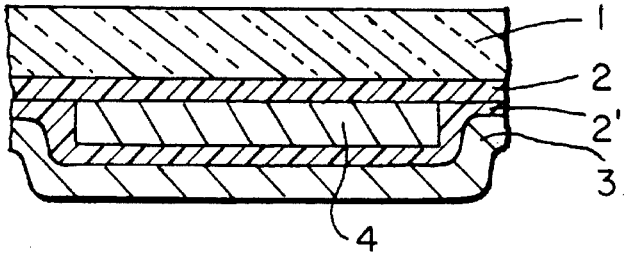
FIG.3 PRIOR ART
FIG. 3 is an enlarged schematic cross sectional view showing a conventional electro-luminescence device described in JP-A-62-76279.
Figure 4:
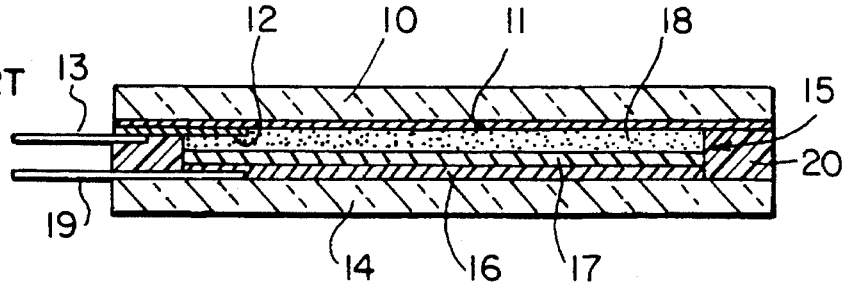
FIG.4 PRIOR ART
FIG. 4 is an enlarged cross sectional view showing a conventional electro-luminescence device described in JU-A- 59-129197.

One embodiment of the electro-luminescence device of the present invention is schematically shown in FIG. 1 as an enlarged cross sectional view. As shown in FIG. 1, the electro-luminescence device of the present invention is composed of transparent substrate 1 such as a transparent plastic substrate, a glass substrate, etc., having successively laminated thereon transparent electrode 2, luminous layer 3, dielectric layer 4, and back electrode 5, with back protective material 6 being adhered to back electrode 5 through adhesive resin film 7.

As the adhesive resin film being used for the electro-luminescence device of the present invention, an adhesive polyolefinic film such as an ethylene-vinyl acetate copolymer film (e.g., ADMER Film VE300 or NE050, produced by Tocelo Kagaku K.K.) and a rubbery film such as a film of nitrile rubber (T-5300, produced by Nitto Denko Corp.), a film of chloroprene rubber (M-5250, produced by Nitto Denko Corp.) can be used.

The thickness of the adhesive resin film is as thin as possible if a sure or firm adhesion is to be obtained but the minimum thickness is limited to from about 10 to 30 μm for practical use from the points of surely adhering the surface protective material regardless of the unevenness of the back electrode, etc., and ease of handling in the adhesion step.

As the transparent substrate for the electro-luminescence device of the present invention, ordinary glass substrates such as a borosilicate glass substrate, a blue plate glass substrate, etc., or transparent synthetic resin substrates such as a polycarbonate substrate, an acryl resin substrate, etc., can be used.

As the transparent electrode for the electro-luminescence device of the present invention, for example, an electrically conductive film of tin oxide called an NESA film and a transparent electrode composed of a composite oxide of indium oxide and tin oxide, which is called an ITO film, can be used. Such a transparent electrode is formed as a thin film or layer on the surface of the transparent substrate by a vacuum vapor deposition method, a sputtering method, or a method of coating a salt of a corresponding metal on the transparent substrate and calcining it in an oxidative atmosphere.

As the luminous layer for the electro-luminescence device of the present invention, any ordinary luminous layer may be used. For example, the luminous layer is formed by coating a dispersion formed by dispersing particles obtained by doping zinc sulfide with an element such as aluminum, copper, manganese, silver, chlorine, etc., as an activating agent in an organic high dielectric material. Coating of the luminous layer is carried out by a screen printing method, a doctor blade coating method, a roll coater coating method, etc., and the coated luminous layer is heated on a hot plate, heated while vacuumizing, or heat-dried by a hot blast or far infrared rays to form the film thereof.

As the foregoing organic high dielectric material, organic cyanoethyl compounds such as cyanoethylated cellulose, cyanoethylated saccharose, cyanoethylated pullulan, cyanated poval, etc., or the derivatives thereof such as the esters, etc., and organic high molecular compounds such as fluorine rubber, an epoxy resin, etc., are used. The foregoing luminous material particles are added to the organic high dielectric material at a ratio of from about 0.5 to 3.0 by volume, and the mixture is fluidized by dispersing in an organic solvent such as dimethyl formamide, cyclohexanone, methyl pyrrolidone, propylene carbonate, ethylene glycol monomethyl ether, diethylene glycol monomethyl ether, etc., for use.

The dielectric layer for the electro-luminescence device of the present invention is also called an insulating layer or a reflective layer. As an example, the dielectric layer can be formed by coating a fluidized dispersion of fine particles of barium titanate, titanium oxide, etc., using the organic high molecular compound-and the organic solvent used for the luminous layer as described above.

The back electrode for the electro-luminescence device of the present invention is formed by coating an electrically conductive paste obtained by dispersing fine particles of silver, copper, nickel, carbon, etc., in, for example, an epoxy resin, a urethane resin, an acrylic resin, a polyester resin, etc., and caking to form the film by the same method as the case of forming the luminous layer or the dielectric layer as described above.

The back electrode and the transparent electrode are each connected with leading wires for driving the electro-luminescence device.

As the back protective material for the electro-luminescence device of the present invention, a moisture impermeable film or sheet selected from a metal foil, a glass plate, a composite film formed by laminating a synthetic resin film onto one surface or both surfaces of a metal foil, and a composite film formed by laminating a metal foil onto one surface or both surfaces of a synthetic resin film can be used.

More specifically, moisture impermeable films such as a composite film formed by laminating a synthetic resin film on both sides of an aluminum foil, a composite film formed by vapor depositing a material such as a metal, glass, etc., onto a synthetic resin film, etc., or a moisture impermeable plate which is the same as the foregoing transparent substrate can be used.

The adhesion of the electro-luminescence layer and the back protective material with the adhesive resin film is carried out as shown below.

The adhesive resin film is inserted between the electro-luminescence layer on the transparent substrate and the back protective material and they are heated to, e.g., 140° C. in a vacuum laminator to soften or melt the adhesive resin film. Then, when the pressure is reduced, degassing occurs between the transparent substrate and the back protective material to adhere both the members to each other. Thereafter, when the assembly is pressed, a further sure or firm adhesion is obtained.

At the adhesion, (1) a laminate of the transparent substrate and the electro-luminescence layer, (2) the adhesive resin film, and (3) the back protective material can be laminated in succession, or the adhesive resin film (2) is previously adhered to the back protective material (3) and the adhered members can be laminated on the laminate (1).

Sealing of the electro-luminescence element with the adhesive resin film is better in the production efficiency than a method of coating an adhesive. Also, by using the adhesive resin film having a thickness of from 10 to 200 μm, preferably 15 to 200 μm and more preferably from 30 to 100 μm, the permeation of moisture from the adhered portions can be controlled and the electro-luminescence element having a high moisture resistance can be produced. In addition, the adhesive resin film can have a thickness of from 10 to 100 μm.

Furthermore, by coating the peripheral portion of the adhered portion of the electro-luminescence device of the present invention with a thermosetting or ultraviolet ray setting epoxy resin, acrylic resin, etc., to seal the portion together with a sealing means using a conventional adhesive, an electro-luminescence device having a higher moisture resistance can be produced.

Thus, as described above, according to the present invention, by forming an adhesive synthetic resin film having a thin thickness between the transparent substrate and the back protective material of the electro-luminescence device and joining the back protective material and the transparent substrate by heating, an electro-luminescence device having a very high moisture resistance, capable of being used even outdoors for a long period of time, and having a luminous surface with a good finished appearance can be obtained.

The electro-luminescence device of the present invention is described in more detail by the following non-limiting examples. Unless otherwise indicated, all parts, percents, ratios and the like are by weight.

EXAMPLE

On a borosilicate glass substrate 115 mm×115 mm×2 mm in size was formed a thin layer of tin oxide ($SnO_2$) as a transparent electrode. Then, a composition obtained by dispersing 1 part by weight of a zinc sulfide type luminous material in a solution composed of 0.3 part by weight of cyanoethylated pullulan and 0.5 part by weight of dimethyl formamide was coated on the transparent electrode thus formed excluding the peripheral portions of 3 mm from each edge by a screen printing method at a thickness of 40 μm followed by drying at 120° C. for 2 hours to form a luminous layer.

Then, a composition obtained by dispersing 1 part by weight of barium titanate ($BaTiO_3$) as a dielectric material in a solution composed of 0.2 part of cyanoethylated pullulan and 0.3 part of dimethylformamide was coated on the luminous layer by a screen printing method at a thickness of 20 μm with 1 mm extending from each edge of the luminous layer followed by drying at 120° C. for 2 hours to form a dielectric layer.

On the dielectric layer was formed a back electrode leaving 1 mm from each edge of the dielectric layer.

The foregoing back electrode was formed by coating an electrically conductive paste composed of fine particles of carbon dispersed in a urethane resin on the dielectric layer by a screen printing at a thickness of 20 μm and dried by heating at 120° C. for 2 hours.

Then, an ethylene-vinyl acetate copolymer film (ADMER Film VE300 produced by Tocelo Kagaku K.K.), a nitrile rubber film or a chloroprene series film (T-5300 or M-5200, respectively, each produced by Nitto Denko Corp.) having each thickness as shown in Table 1 below was placed on the back electrode as an adhesive resin film. Thereafter, a back protective material composed of a composite film 115 mm×115 mm in area formed by laminating a polyester film onto both sides of an aluminum foil was superposed on the adhesive resin film, and after vacuum-degassing in a rectangular vacuum laminator, they were adhered to each other at a temperature of 140° C. and a pressure of 1 kg/cm$^2$ to provide an electro-luminescence device.

The back electrode and the transparent electrode were each connected with leading wires for driving the electro-luminescence device.

After storing the resulting electro-luminescence device for from 24 to 240 hours at 60° C. and 95% relative humidity, the electro-luminescence device was lighted for 4 hours under the condition of 100 volts and 400 Hz, and then the appearance of the electro-luminescence device was observed.

In the case of entering moisture in the electro-luminescence device, when the electro-luminescence device was lighted, the surface thereof was blackened by the deterioration thereof.

The results obtained are shown in Table 1 below.

The evaluation standards of the appearance in the Table are shown as follows.

E: No change

G: Corner portions slightly blackened.

F: Corner portions greatly blackened.

P: Edges also blackened.

TABLE 1

| Material of Adhesive Resin Film | Thickness (μm) | Stored Time (hour) 24 | 96 | 168 | 240 |
|---|---|---|---|---|---|
| Ethylene-Vinyl Acetate (EVA) Copolymer Film | 30 | — | E | E | G |
| EVA Copolymer Film | 50 | — | E | E | G |
| EVA Copolymer Film | 100 | — | E | G | G |
| EVA Copolymer Film | 200 | — | G | G | F |
| Nitrile Rubber Film | 50 | — | E | E | — |
| Chloroprene Rubber Film | 50 | — | E | E | — |
| EVA Copolymer Film | 400 | F | P | — | — |

TABLE 1-continued

| Material of Adhesive Resin Film | Thickness (μm) | Stored Time (hour) 24 | 96 | 168 | 240 |
|---|---|---|---|---|---|
| EVA Copolymer Film | 600 | F | P | — | — |

Also, the luminous surface was good without being accompanied by the occurrence of waved patterns.

As described above, by adhering the back electrode of the electro-luminescence device and the back protective material with an adhesive resin film having a thickness of 10 to 200 μm, an electro-luminescence device having a very high moisture resistance, usable even outdoors for a long period of time, and having a luminous surface with good finish can be obtained.

While the invention has been described in detail and with reference to specific examples thereof, it will be apparent to one skilled in the art that various changes and modifications can be made therein without departing from the spirit and scope thereof.

What is claimed is:

1. An electro-luminescence device comprising a laminate composed of a transparent substrate having successively laminated thereon a transparent electrode, a luminous layer, a dielectric layer, and a back electrode, with a back protective material being adhered to the back electrode through an adhesive resin film, wherein the back protective material is a moisture impermeable protective material and the adhesive resin film is a thermoplastic resin film having a thickness of from 10 to 200 μm.

2. An electro-luminescence device of claim 1, wherein the back protective material is a moisture impermeable film or sheet selected from the group consisting of a metal foil, a glass plate, a composite film formed by laminating a synthetic resin film onto one surface or both surfaces of a metal foil, and a composite film formed by laminating a metal foil onto one surface or both surfaces of a synthetic resin film.

3. An electro-luminescence device of claim 1, wherein the thickness of the adhesive resin film is from 10 to 100 μm.

4. An electro-luminescence device of claim 2, wherein the thickness of the adhesive resin film is from 10 to 100 μm.

5. An electro-luminescence device of claim 1, wherein the thickness of the adhesive resin film is from 15 to 200 μm.

6. An electro-luminescence device of claim 2, wherein the thickness of the adhesive resin film is from 15 to 200 μm.

7. An electro-luminescence device of claim 1, wherein the thickness of the adhesive resin film is from 30 to 100 μm.

8. An electro-luminescence device of claim 2, wherein the thickness of the adhesive resin film is from 30 to 100 μm.

9. An electro-luminescence device comprising a laminate composed of a transparent substrate having successively laminated thereon a transparent electrode, a luminous layer, and a back electrode, with a back protective material being adhered to the back electrode through an adhesive resin film, wherein the back protective material is a moisture impermeable protective material and the adhesive resin film is a thermoplastic resin film having a thickness of from 10 to 200 μm.

* * * * *